US010717312B2

(12) United States Patent
Pohjola et al.

(10) Patent No.: US 10,717,312 B2
(45) Date of Patent: Jul. 21, 2020

(54) METHOD FOR PRODUCING A DATA CARRIER AND DATA CARRIER PRODUCED THEREFROM

(71) Applicant: GEMALTO SA, Meudon (FR)

(72) Inventors: Teemu Pohjola, Meudon (FR); Kristian Lappalainen, Meudon (FR)

(73) Assignee: Thales Dis France SA, Meudon (FR)

( * ) Notice: Subject to any disclaimer, the term of this patent is extended or adjusted under 35 U.S.C. 154(b) by 0 days.

(21) Appl. No.: 16/342,145

(22) PCT Filed: Oct. 24, 2017

(86) PCT No.: PCT/EP2017/077142

§ 371 (c)(1),
(2) Date: Apr. 15, 2019

(87) PCT Pub. No.: WO2018/086874

PCT Pub. Date: May 17, 2018

(65) Prior Publication Data

US 2019/0255876 A1 Aug. 22, 2019

(30) Foreign Application Priority Data

Nov. 10, 2016 (EP) ..... 16306481

(51) Int. Cl.
*B42D 25/45* (2014.01)
*B42D 25/351* (2014.01)
(Continued)

(52) U.S. Cl.
CPC ..... *B42D 25/45* (2014.10); *B42D 25/23* (2014.10); *B42D 25/24* (2014.10); *B42D 25/309* (2014.10);
(Continued)

(58) Field of Classification Search
None
See application file for complete search history.

(56) References Cited

U.S. PATENT DOCUMENTS 4,765,656 A 8/1988 Becker et al.
5,944,356 A 8/1999 Bergmann et al.
2009/0310470 A1* 12/2009 Yrjonen ..... B41M 3/14 369/116

(Continued)

FOREIGN PATENT DOCUMENTS

EP 0216947 A1 4/1987

OTHER PUBLICATIONS

PCT/EP2017/077142, International Search Report, dated Jan. 9, 2018, European Patent Office, P.B. 5818 Patentlaan 2 NL—HV Rijswijk.
PCT/EP2017/077142, Written Opinion of the International Searching Authority, dated Jan. 9, 2018, European Patent Office, D-80298 Munich, Germany.

* cited by examiner

*Primary Examiner* — Kristy A Haupt
(74) *Attorney, Agent, or Firm* — The Jansson Firm; Pehr B. Jansson

(57) ABSTRACT

The present invention relates generally to a data carrier comprising an opaque layer and a method for making the data carrier. During personalization phase, the ablation of the opaque layer by laser through the data carrier allows to define a see-through portion of the data carrier carrying opaque security, said see-through portion having an improved security corresponding to opaque embossing pattern overlapping at least partially the opaque security partially destroyed. Said defined see-through portion carrying opaque security partially destroyed with opaque embossing pattern on its surface is even more difficult to reproduce by forger, even more difficult to remove, replace or exchange and easy to check.

18 Claims, 2 Drawing Sheets

(51) Int. Cl.

| | |
|---|---|
| ***B42D 25/373*** | (2014.01) |
| ***B42D 25/382*** | (2014.01) |
| ***B42D 25/387*** | (2014.01) |
| ***B42D 25/435*** | (2014.01) |
| ***B42D 25/328*** | (2014.01) |
| ***B42D 25/46*** | (2014.01) |
| ***B42D 25/455*** | (2014.01) |
| ***B42D 25/24*** | (2014.01) |
| ***B42D 25/324*** | (2014.01) |
| ***B42D 25/23*** | (2014.01) |
| ***B42D 25/309*** | (2014.01) |

(52) U.S. Cl.
CPC ..... *B42D 25/324* (2014.10); *B42D 25/328* (2014.10); *B42D 25/351* (2014.10); *B42D 25/373* (2014.10); *B42D 25/382* (2014.10); *B42D 25/387* (2014.10); *B42D 25/435* (2014.10); *B42D 25/455* (2014.10); *B42D 25/46* (2014.10)

(56) References Cited

U.S. PATENT DOCUMENTS

2013/0154250 A1 6/2013 Dunn et al.
2014/0023838 A1* 1/2014 Egli ..... B42D 25/23
428/204

METHOD FOR PRODUCING A DATA CARRIER AND DATA CARRIER PRODUCED THEREFROM

TECHNICAL FIELD

The present invention relates generally to a data carrier and a method for making the data carrier. More particularly, this invention relates to a data carrier comprising embossing surface structure in aligned superposed relationship with a resulting metallic copy of said embossing surface into the data carrier during a personalization process, said resulting appearance of a metallic embossing surface structure overlapping at least partially a metalized security features with a different appearance under different lighting conditions, and a method for making such a data carrier.

BACKGROUND ART

Data carriers, such as driving licenses, identity cards, membership cards, badges or passes, passports, discount cards, banking cards, money cards, multi-application cards, other security documents and papers of value; and security documents such as bank notes are widely used. Because of the value and importance associated with each of these data carriers, they are often the subject of unauthorized copying and alterations, and forgeries.

It exists a very wide variety of security features for protecting the data carrier. Often, however, it is the case that the forger does not forge a complete data carrier but modifies or replaces the personalized data (photograph, date of birth, signature, name, etc.) on an e.g. stolen data carrier. The protection of these personalized data is therefore very important.

To prevent such activities from being carried out on these data carriers, different types of visual and touchable security features have been added to data carriers.

One of these security features is a personalized metalized see-through portion through the body of a data carrier. The known method of making a data carrier with a metalized see-through window involves producing a multilayer data carrier comprising a first layer which is made of plastic and has an upper face on which an opaque layer partially covering said upper face, for example a metal layer, is arranged. The data carrier has a second layer made of plastic which is disposed on the first layer and is transparent at least in a sub-region of the metal layer. To write the personalization data, the metal layer is partially ablated by a laser. This personalized metalized see-through portion allows to better protect the data carrier against unauthorized modifications.

Although such a data carrier is, to a certain extent, protected against copying, forgery and manipulation, it can nevertheless still be manipulated. Indeed, the personalized metalized see-through window can be removed and replaced with something else or insert it into another data carrier. Fakes security feature imitating some or even all of the security elements of the metalized see-through window can be made. Another issue is that the personalized data can be graphically altered.

It is therefore desirable to produce data carriers with elevated protection against forgery and manipulation using a method that is simple and cost effective.

Considering the above, a problem intended to be solved by the invention is to provide a data carrier comprising an opaque layer into its body and embossing pattern on its surface, the embossing pattern overlapping at least partially said opaque layer. During personalization phase, the markings on the opaque layer by laser through the data carrier allows to write opaque security markings such as personalization data. During the personalization phase, the embossing pattern is copied into the opaque layer so that to create opaque security markings resulting to an appearance of an opaque embossing pattern. Said opaque security markings allow to improve the security of the opaque security markings. Said defined opaque security markings with an appearance of an opaque embossing pattern on its surface is even more difficult to reproduce by forger, even more difficult to remove, replace or exchange and easy to check.

SUMMARY OF THE INVENTION

The following summary of the invention is provided in order to provide a basic understanding of some aspects and features of the invention. This summary is not an extensive overview of the invention and as such it is not intended to particularly identify key or critical elements of the invention or to delineate the scope of the invention. Its sole purpose is to present some concepts of the invention in a simplified form as a prelude to the more detailed description that is presented below.

The present invention addresses the aforementioned forgery and manipulation drawbacks on data carrier. The present invention relates to a data carrier and a method for making the data carrier.

The invention relates in particular to a multilayer data carrier of thermoplastic (for example polycarbonate, PVC, PET-G). According to the present invention, an opaque destroyable portion is applied at least partially onto one of the layers of the data carrier.

According to one refinement of the invention, the opaque destroyable portion can be a metallized thin layer applied partially onto one of the layers. This metallized layer may for example be vapor deposited, applied by hot stamping or laminated together with a carrier layer (for example PET) between two layers of the data carrier.

In an embodiment, the layer with the partially applied metal layer can be then laminated together with the further layers of the cards to form a card body. In this case, the layer with the applied metal is covered with at least one further transparent layer. The layer onto which the metal is applied may be either transparent or opaque.

According to an embodiment of the present invention, during lamination a lamination plate featured with surface patterns is applied onto the cover layer of the layer onto which the metal layer is applied. The lamination plate is positioned so that at least some of the plate features overlap the metal layer (there is a registration procedure in place to ensure positioning of the two within certain tolerances).

According to another embodiment of the present invention, the metal layer is applied in a rear surface of a layer. And during lamination, a lamination plate featured with surface patterns is applied onto the upper surface of this layer. The lamination plate is positioned so that at least some of the plate features overlap the metal layer applied into the rear surface of this layer.

The surface patterns overlapping at least partially the metal layer forms a beam modifying portion comprising a beam modifying property. The beam modifying property of the beam-modifying portion includes any property of the beam-modifying portion that is able to modify any one of the size, intensity, direction, positioning, etc. of the laser beam. For example, the laser beam may be scattered, diffracted which includes bending, spreading and interfering, dispersed and/or distorted when it is irradiated through the beam-modifying portion having the beam modifying property. According to other embodiments, the beam modifying property relates to a geometric property or profile of the beam-modifying portion, such as surface undulations and smoothness, thickness of the layer, etc.

The beam modifying property allows, during personalization phase when irradiating a laser beam through the beam-modifying portion, to modify at least one beam property to produce a resultant laser beam. The resultant laser beam creates a hole with a visual impression corresponding to the resultant laser beam at the metal layer.

The beam modifying property can serve as optical lenses diverting the laser beam. The beam modifying property is configured to enable a certain level of control over the destroying process onto the metal layer to particularly transfer or copy the surface pattern into the metal layer.

During personalization of the data carrier, that is to say when writing the cardholder's data onto the card, the metal layer is then partially destroyed, (which can be evaporated, recessed, color changed, color altered or removed), using a laser. For this process, it is possible to use the same type of laser as is employed for the data carrier personalization known from the prior art (laser marking by means of blackening or laser engraving). It is, however, also possible to use a laser with a different wavelength.

At the positions where the laser strikes the metal layer, a hole, a change of color or a recess can be formed in the metal layer. Text or matrix images can therefore be written into the metal sheet using the laser.

When the metal layer is destroyed, the sheet below the metal layer can be visible through the gap or the color changed left in the metal sheet. Depending on whether this sheet is transparent or opaque, the image formed in the metal layer is optimally visible in transparent view (in the case of a transparent sheet) or direct view (in the case of an opaque sheet). Owing to the reflection behavior of the metal layer, the image can be seen in direct view as "positive" (dark) or "negative" (light) depending on the viewing angle.

During the personalization phase, the surface pattern is transferred or copied into the metal layer when irradiating the laser beam through the beam-modifying portion. The surface pattern written into the metal layer is in a superposing relation with the surface pattern on the cover layer. This superposing relation create an appearance of a metalized embossing pattern.

The image formed in the metal layer is overlapped entirely or partially by metalized embossing patterns according to the position of the beam-modifying portion over the metal layer.

With the present invention, the same exact resultant from the personalization phase corresponding to a metalized embossed pattern overlapping at least partially a metalized personalized data is difficult to be obtained or removed thereat.

It is known to apply tactile features over normal laser sensitive plastic such as doped polycarbonate that reacts to the laser beam. Instead, the present invention relates with laser sensitive metallic or metalized film inside plastic body (card or datapage) that when irradiated with laser is locally destroyed. In other words, the foil gets holes through it and the more power one uses the bigger the destruction and the holes become.

In an embodiment, the metal layers is selected so thin that it is not feasible to actually make markings to them other than such holes. And then the optical structure on top moderates and redirects the laser and locale "saves" the foil from destruction.

The present invention allows to provide an extra layer of security to the metalized personalized data by applying tactile features over the personalized data that interact with the laser beam leading on one hand to metalized tactile effects, "metalized embossing", and on another hand to optically variable effects in an otherwise dull/matt foil, "optically variable metal foil".

To achieve those and other advantages, and in accordance with the purpose of the invention as embodied and broadly described, the invention proposes a method of producing a data carrier, wherein the data carrier comprises an opaque layer portion applied into two layers of a body of the data carrier and a beam-modifying portion applied onto a surface of the body of the data carrier, said beam-modifying portion being positioned at least partially overlapping the opaque layer portion, said beam-modifying portion having an optical property capable of modifying a laser beam, the method comprising:

- the opaque layer is selected so thin that an irradiation by the laser beam results on a local destruction of said opaque layer,
- irradiating the laser beam to the opaque layer portion through the surface of the data carrier of partially destroying the opaque layer in such a way that it creates an opaque personalized data,
- irradiating the laser beam to the opaque layer portion through the beam-modifying portion to allow the modifying of the laser beam according to the optical property to produce a resultant laser beam that locally destroy said opaque layer portion, in such a way that it creates an opaque pattern with a visual impression of an opaque embossed structures corresponding to the result of the irradiation of the beam-modifying portion.

According to an embodiment of the present invention, the data carrier is a multilayer data carrier comprising:

- a first layer of plastic that comprises an upper side;
- a second layer of plastic comprising a rear side and an upper side,
- the opaque layer is arranged on said upper side of said first layer and partially covering said this upper side;
- the rear side of the second layer of plastic is arranged on the first layer,
- said second layer being transparent at least in a subregion of the opaque layer being.

According to an embodiment of the present invention, said upper side of the second layer comprising a plurality of raised surface portions comprising each an embossing beam-modifying portion, said embossed beam-modifying portion comprising a surface profile having an optical property capable of modifying a laser beam, said embossed beam-modifying portion being positioned adjacent or at least partially over the opaque layer portion.

According to an embodiment of the present invention, the data carrier is a multilayer data carrier wherein The opaque layer being arranged on said rear side of said second layer and partially covering said this rear side of the second layer, said second layer being transparent at least in a subregion of the opaque layer.

According to an embodiment of the present invention, the opaque layer is laminated between the first and the second plastic layers.

According to an embodiment of the present invention, the opaque layer is arranged in a window of the otherwise at least regionally opaque layer.

According to an embodiment of the present invention, a layer of the data carrier is printed in a color before application of the opaque layer in the first layer or the second layer, so that the color is visible after the destroying on the opaque layer by the irradiation steps.

According to an embodiment of the present invention, the opaque layer is a metal layer wherein to create the opaque personalized data and the opaque pattern the step of partially destroying the opaque layer is using the laser beam until the metal layer has at least recessed, evaporated, color changed, color altered or removed.

According to an embodiment of the present invention, the opaque layer comprises at least two metal sheets arranged at a distance from one another and parallel above one another, these two metal sheets are provided with destroying, wherein the two metal layers are exposed vertically with respect to their plane or at an inclination with respect to their planes so that the destroying extend vertically or at an inclination with respect to said planes.

According to an embodiment of the present invention, the metal layer is vapor deposited onto the first layer or the second layer, applied by hot stamping or laminated together with a carrier layer.

According to an embodiment of the present invention, owing to the reflection behavior of the metal layer, the metalized personalized data and the metalized pattern when viewed can be seen as positive or negative depending on the viewing angle.

According to an embodiment of the present invention, the opaque layer is produced from a material which is modified during the exposure of the laser beam in such a way that it becomes transparent or at least translucent in the exposed region during the step of partially destroying the opaque layer when creating the opaque personalized data and the opaque pattern.

According to an embodiment of the present invention, the material of the opaque layer is a plastic layer which has an additive that modifies the plastic layer during the exposure to the laser beam in such a way that the material becomes transparent in the exposed region or the material of the opaque layer is produced from a pigmented or semicrystalline plastic.

The present invention is also related to a data carrier resulting from a method of producing such data carrier, said data carrier comprising:

- a first layer of plastic that comprises an upper side;
- a second layer of plastic comprising a rear side and an upper side,
- an opaque layer that is arranged between said rear side of the second layer and the upper side of the first layer,
- said rear side of said second layer of plastic being arranged on the upper side of the first layer, said second layer being transparent at least in a subregion of the opaque layer,
- said upper side of the second layer comprising a plurality of raised surface portions comprising each an embossing beam-modifying portion, said embossed beam-modifying portion comprising a surface profile having an optical property capable of modifying a laser beam, said embossed beam-modifying portion being positioned adjacent or at least partially over the opaque layer portion.

According to an embodiment of the present invention, the opaque layer is arranged on said rear side of said second layer and partially covering said this rear side.

According to an embodiment of the present invention the opaque layer is arranged on said upper side of said first layer and partially covering said this upper side.

According to an embodiment of the present invention, the data carrier is an identity card, a page of a passport, a credit card or the like.

BRIEF DESCRIPTION OF THE DRAWINGS

The following detailed description will be better understood with the drawings, in which.

DETAILED DESCRIPTION OF THE EMBODIMENTS OF THE INVENTION

Figure 1:
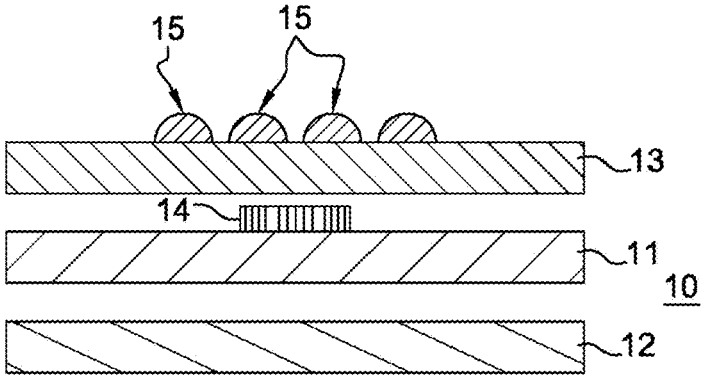
FIGS. 1, 3 and 4 schematically illustrates a cross section through of a multilayer data carrier according to the invention according to different embodiments.

As shown in the drawings for purposes of illustration, the invention is embodied in a method of producing a data carrier and a data carrier produced using the method. The data carrier comprises an opaque laser-destroyable portion and a beam-modifying portion overlapping at least partially the opaque laser portion. The beam-modifying portion is a beam-modifying protective layer of the opaque laser-destroyable layer.

The action of suitable laser radiation on the opaque laser-destroyable portion used in accordance with the invention results in creating holes into the opaque laser portion to obtain an irreversible and visually readily detectable change into the opaque laser portion.

In an embodiment, the laser radiation printing method used can be a laser marking method wherein a local destruction of the opaque laser portion is observed by local heating of the opaque laser portion.

In another embodiment, the laser radiation printing method used can be a laser engraving method wherein material is ablated from the opaque laser portion. This ablation process can be carried out by the laser beam with removal, evaporation, or recess on the opaque laser portion.

During the action of the laser printing onto the opaque laser-destroyable portion, selective part of the opaque laser portion are present in the form of gaps in the opaque laser portion.

The selective gaps of said opaque laser portion producing, if desired, microinscriptions and/or images. Microinscriptions and/or images can be produced with different sizes and line thicknesses.

The laser beam is irradiated through the beam-modifying portion to produce holes corresponding to a copy or a transfer of the pattern of the beam-modifying portion into the opaque laser-destroyable portion.

It is to be understood that various other embodiments and variations of the invention may be produced without departing from the spirit or scope of the invention. The following is provided to assist in understanding the practical implementation of particular embodiments of the invention.

The same elements have been designated with the same referenced numerals in the different drawings. For clarity, only those elements and steps which are useful to the understanding of the present invention have been shown in the drawings and will be described.

Reference throughout the specification to "an embodiment" or "another embodiment" means that a particular feature, structure, or characteristic described in connection with an embodiment is included in at least one embodiment of the subject matter disclosed. Thus, the appearance of the phrases "in an embodiment" or "in another embodiment" in various places throughout the specification is not necessarily referring to the same embodiment. Further, the particular features, structures or characteristics may be combined in any suitable manner in one or more embodiments.

Hereafter, an embodiment of the present invention will be described in the context of data carrier and a method for producing it. However, it is to be understood that the invention is usable with any data carrier that includes a laser marking as a verifiable mark of authentication. Such a data carrier includes, but is not limited to, a driving license, a badge or pass, a passport, a discount card, a membership card, a banking card, a credit card, a money card, a multi-application card, and other security documents and papers of value that are to be provided with information or data in such a way that they cannot be easily imitated by common means and are also protected from attempted manipulation.

Data carriers are generally made with several layers coated or not, made in plastic material, such as polycarbonate, polyvinyl chloride (PVC), polyethylene terephthalate (PET) or acrylonitrile butadiene styrene (ABS). It may also be combination of these plastic materials.

Hereinafter reference will be made to FIGS. 1 to 4 to describe laminating sheet, in the layer structure of which a laser-induced individualization can be produced for the purposes of affording a forgery-proof nature and to provide combinatory visual effects.

The various sheet shown in the Figures will now be described in regard to their layer structure and the material composition of the individual layers.

FIG. 1 shows a data carrier 10 comprising an opaque core sheet 11, a lower transparent cover sheet 12 and an upper transparent cover sheet 13. The data carrier 10 comprises an opaque layer 14 placed between two layers.

In the example illustrated hereinafter, the opaque layer 14 is between the core sheet 11 and the cover sheet 13. In an embodiment, the opaque layer 14 is applied onto an upper side of the core sheet 11. In another embodiment, the opaque layer 14 is applied in a rear surface of the cover sheet. The rear surface of the cover sheet 13 is in direct opposing face with the upper side of the core sheet 11.

In an embodiment, the opaque layer 14 is a metal layer. The metal layer is for example vapor deposited or applied by hot stamping. In what follows, a metal layer also refers to a metallized layer or a metallic layer. Such layers are known per se. The metal sheet may also be formed as a hologram. The cover sheet 13, the core sheet 11 and the lower cover sheet 12 are bonded in a manner known per se by lamination. The metal layer then correspondingly lies between the core sheet 11 and the cover sheet 13.

The metallized layer is advantageously thinner than 4 μm, in the ideal case thinner than 1 μm. If it is laminated together with a carrier layer, the carrier should be no thicker than 50 μm, in the ideal case about 20 μm or thinner. Indeed, the metal layers is selected so thin that it is not feasible to actually make markings to them other than such holes. And then the optical structure on top moderates and redirects the laser and locale "saves" the foil from destruction.

The metallized layer may contain holographic diffraction structures. The metallized layer consists, for example, of aluminum, although other metals may be envisioned, for example titanium. The techniques for applying the metal layer onto a thermoplastic sheet are known to the person skilled in the art.

In another embodiment, the opaque layer 14 is a thin opaque plastic layer having a special additive. This special additive allows to modify the opaque plastic layer during the exposure of a laser radiation in such a way that it becomes transparent or at least translucent. The additive is, for example, a pigment which can be destroyed during the exposure to the laser radiation. Such pigments are known to the person skilled in the art. Instead of a pigmented plastic, it is possible to use a semicrystalline opaque plastic in which the macromolecules arranged in crystallites are converted into an amorphous and transparent structure by the heat input of the laser radiation.

In the description hereinafter, the opaque layer 14 is the metal layer knowing it can be any kind of opaque layer above described.

The upper surface of the cover sheet 13 comprises embossed pattern 15. These embossed pattern 15 can be fine relief structures whose geometrical parameters of spacing, orientation and profile shape are able to change a beam property of a laser beam irradiated therethrough.

In an embodiment, the embossed pattern 15 can be raised onto the cover sheet 13 during manufacturing phase of the cover sheet 13. In another embodiment, the embossed pattern 15 can be raised onto the cover sheet 13 during lamination phase of the data carrier 10. In another embodiment, the embossed pattern 15 can be raised onto the cover sheet 13 after lamination phase of the data carrier 10. The embossed pattern 15 onto the cover sheet 13 can be made from any technology enabling relief structuring onto a surface.

In the embodiment herein after described, the embossed pattern 15 is raised onto the cover sheet 13 during lamination phase of the data carrier 10. For that, the core sheet 11 is laminated with the cover sheet 13 using a laminating plate having a patterned contacting surface. A layer of adhesive (not shown) may be used between the lower cover sheet 12, the cover sheet 13 and the core sheet 11 to fixedly attach the three layers to each other. For PC data carrier, it is possible to laminate the layers together without the use of adhesive. The thickness of each layer may be in the range of thirty to hundreds of microns as long as the total thickness of the data carrier 10 does not exceed that specified in the standards, for example, the ISO standards.

The patterned contacting surface of the laminating plate when brought into contact with the cover sheet 13, for example during lamination, creates a corresponding embossed pattern 15 on the surface of the cover sheet 13 to define a surface profile.

The laminating plate having a patterned contacting surface is arranged over the metal layer 14 in order to enhance the forgery-proof nature. The position of the embossed pattern 15 can be provided to be disposed over the opaque layer hereinafter the metal layer 14 in a delimited region which covers at least partially the surface of the metal layer 14. The laser treatment is effected by laser radiation through the cover sheet 13 so that a resulting personalized data 17 from a personalization phase are produced in accurate register relationship with the embossing pattern 15.

The result obtained from this registration is a unique security feature which is composed by an accurate register relationship between the personalized data 17 and the embossed pattern 15.

Figure 5:
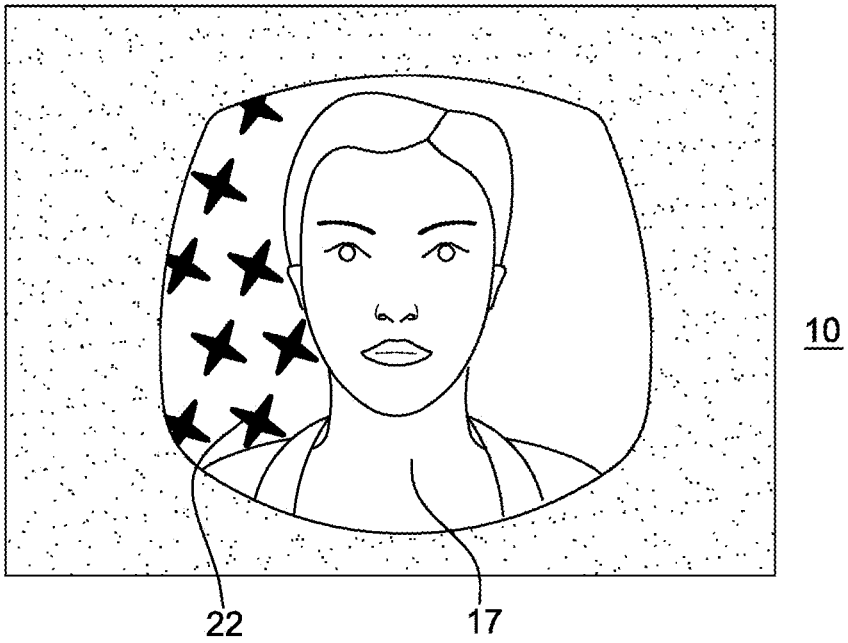
FIGS. 5 and 6 schematically illustrates a plan view of a multilayer data carrier under different lighting conditions according to the invention.
Figure 6:
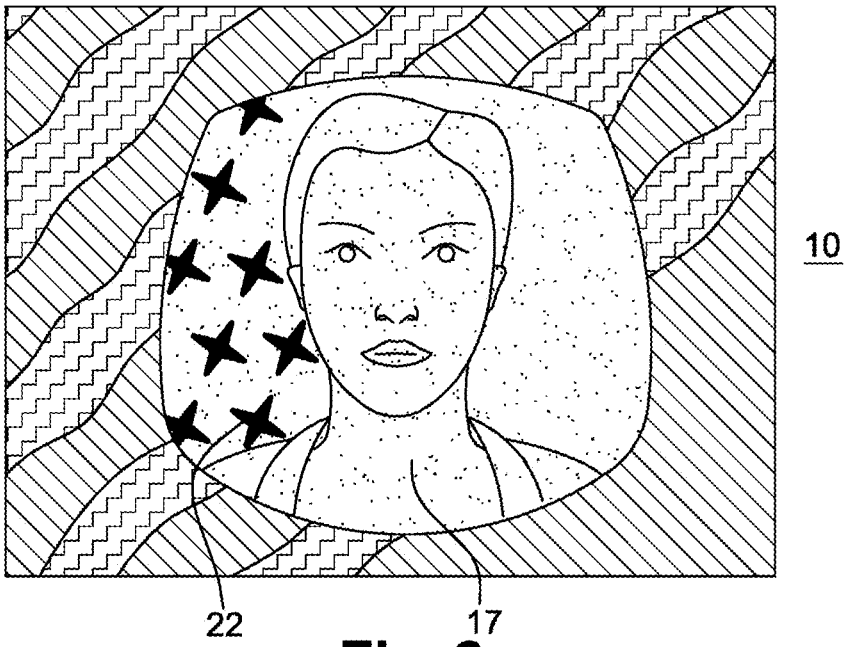

The personalized data 17 and the embossed pattern 15 can be arranged in certain regions, overlapping completely or portion-wise in accurate register relationship, preferably in aligned mutually superposed relationship, see FIG. 5, and FIG. 6.

In an embodiment, the embossed pattern 15 is arranged in register with the metal layer 14 according to known registration means based on registration tolerance requirement.

In an embodiment, the embossed pattern 15 is arranged in register with the metal layer up to some industrial tolerances. The personalization phase is at best registered with respect to the metal layer which is easy to detect with for example machine vision systems or image processing. The embossed pattern 15 is copied to the metal layer with perfect registration with respect to the surface structure (automatically in the laser process) and with the above mentioned tolerance with respect to the personalized data.

The composition in accurate register relationship can be readily checked from the exterior without expensive equipment, preferably by simple viewing thereof, in order to establish authenticity. This means that this specific co-operation of the embossed pattern 15 with the respective personalized data 17 forms a combinatory effect representing a quasi-synergistic effect. Specific combinatory visual effects can be produced under different lighting conditions.

Figure 2:
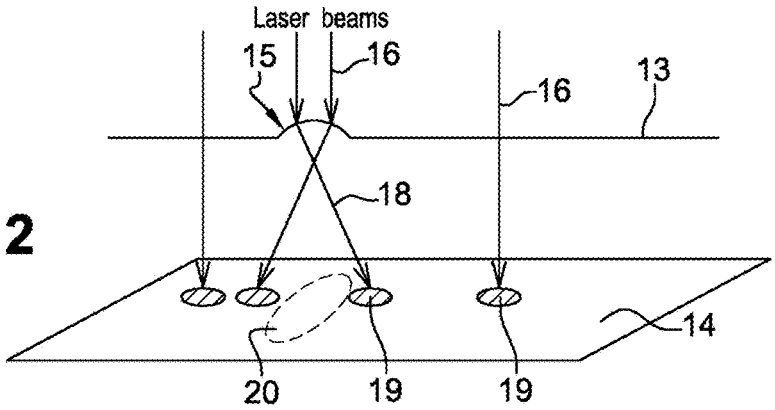
FIG. 2 is a cross sectional drawing of the data carrier further showing a laser beam used to create destroying in the metal layer according to the invention.

During the personalization phase, a laser beam 16 is irradiated through the laminating sheet 13 to create at least the personalized data 17 at the metal layer 14, as shown in FIG. 2. This personalized data 17 includes, but is not limited to, personalized information and data, such as name, date of birth, address, personnel number, signature, portrait, etc.

A laser light source which includes a laser and also an optical system (all not shown) which is necessary for beam guidance and beam focusing is used to generate the laser beam 16. The laser beam 16 may be controlled by a control device, for example a computer (not shown). The laser beam has a spot width of about 25.4 μm. Lasers of other spot widths may also be used.

The power density of the laser beam 16 and the local exposure time of the data carrier 10 are predetermined in such a way that on the one hand the metal layer 14 is destroyed and that the information and data are formed thereat, and that on the other hand the two layers 13, 12 are not damaged or destroyed by the heating effect.

During the personalization phase, the laser printing procedure is applied in a pre-defined window frame of the personalization data 17 to be formed in the metal layer 14. Positioning of the laser in accurate position in the pre-defined window frame can be implemented by suitable control of the laser beam. Preferably control can be effected electronically by the control device, more specifically in dependence on detection of the pre-defined window frame position of the personalized data 17.

The laser can be controlled by the detection of configurational parameters of a background layer, by detection of configurational parameters of the laser-sensitive layer or the laser-induced image constituent, in particular by means of image processing or machine vision system. Preferably the position, the direction of incidence of the laser light, the laser wavelength, the period of action, the number of pulses and/or the laser intensity can be controlled.

During creation of the personalized data, the control device controls the laser beam 16 so that it passes through the laminating sheet 13 which is transparent in respect thereto to be focused onto the metal layer 14 to cause destroying thereat, under the effect of released thermal energy.

Using the laser apparatus, the metal layer 14 is selectively destroyed in such a way that, for example, the personalized data 17 and a resulting pattern 22 can be formed, see FIGS. 5 and 6. The resulting pattern 22 is a result of a copy or transfer of the embossing pattern into the metal layer during the personalization phase. The superposing relationship between the resulting pattern 22 and the embossed pattern 15 creates an appearance of metallic embossed pattern.

During the personalization phase, the embossed pattern 15 modifies the laser beam 16 as shown in FIG. 2 to produce a resultant laser beam 18. This resultant laser beam 18 into the metal layer has a distinctive visual impression corresponding to the resultant laser beam 18. The laser beam 16 is modified by deviation and/or dispersion.

In the embodiment illustrated in FIG. 2, during the laser printing process, at the position when the laser beam 16 or the diverted laser beam 18 hits the metallic layer 14, the metal sheet is destroyed by ablation (evaporation, recess or removal) and a marking 19 is produced. In the example illustrated in FIG. 2, the metal layer 14 is ma by ablation and the marking 19 is a hole illustrated by a black circles.

According to features of the surface of the core sheet 11 which can serve as optical lenses diverting the laser beam and the control of the printing process by the control device, metal layer zones 20 of the metal layer 14 are not hit with the laser beam 16 or the diverted laser beam 18. The metal layer zone 20 is illustrated by a dashed line in FIG. 2. The markings 19 and the metal layer zone 20 form the personalized data 17 and the resulting pattern 22 created from the radiation of the embossing pattern 15.

As illustrated in the FIGS. 5 and 6, the marking 19 and the metal layer zone 20 produce from the radiation of the embossing pattern 15 provide the resulting pattern 22. The resulting pattern 22 and the embossed pattern 15 onto the cover layer 13 form an appearance of a tactile metalized patterns thanks to the opposing relation position between the resulting pattern 22 and the embossed pattern 15.

And moreover, the marking 19 and the metal layer zone 20 from the radiation of the surface of the cover sheet 13 produce the metalized personalized data 17. The resulting pattern 22 and the metalized personalized data 17 are not accessible from the data carrier 10 surface since they are produced in the interior of the data carrier 10. With the holes into the metal layer 14, the metalized personalized data and the tactile metalized pattern 22 is readily viewable and recognizable to a viewer.

In an example of implementation illustrated in FIG. 5, the embossed pattern 15 comprises different sizes of stars partially overlapping for example in the edge the personalized data which is hereinafter a photograph. FIG. 5 illustrates a resulting data carrier after the personalization phase. When looking at the resulting of the metal layer 14 after the personalization phase, in back light which is part of the normal authentication procedure for such metalized personalized window, the normal face of the photograph and the embossed metalized star shape are revealed. As shown in FIG. 6, a normal frontal lighting on the data carrier of FIG. 5 reveals a negative image of the photograph plus the metalized embossed pattern. Titling the resulting of the metal layer 14 after the personalization phase with different conditions of light can reveal optically variable effect of the metalized embossed pattern from the backside.

The embossed pattern 15 resulting to a metalized embossed pattern 22 after the personalization allows to increase the security of the personalized data 17 in several ways. Indeed the metalized features attract attention of anyone looking at the document boosting the role of such a window. The metalized features are obvious and easy to explain making it also obvious if such features are missed in a counterfeit document. The surface patterns leading to the metalized features may be continued across one or more edges of the window making difficult to remove a window from one document and try to place it into another one, or to use as part of a fake.

In another example of implementation (not shown), the embossed pattern 15 comprises lines and letters raised onto the surface of the cover sheet 13 with a round cross section profile. After the personalization process, as a result the lines or letters would be seen as metalized and tactile in the final personalized data 17. As the position of the metalized embossed pattern 22 can impact the view of the personalized data, the embossed pattern 15 can be positioned to one or more corners of the pre-defined featured frame of the personalized data during registration phase in order not to affect the recognizability of the personalized data.

To increase the security against tamper and fraudulent alteration or counterfeit, a layer of the data carrier can be laminated with some specific security features before application of the opaque layer in the core sheet 11, so that the specific security features is visible after the destruction of the opaque layer by the irradiation beam laser.

In an embodiment, the layer of the data carrier laminated with some specific security features is the core sheet 11. In an embodiment, the core sheet 11 can be printed in a color before application of the metal layer, so that the color is visible with the holes into the metal layer and provides a special effect. In another embodiment, the core sheet 11 can be doped with a material to fluoresce under UV light or luminescence under Infra-Red light for additional authentication. In another embodiment, optically variable diffractive devices such as holograms and optical interference based devices can be added to the core sheet 11 before application of the metal layer.

In an embodiment, the metal layer 14 can be introduced or applied, respectively, onto or into a transparent window in the data carrier, so that the personalized data 17 and the resulting pattern 22 are visible in transparent view but the rest of the data carrier comprises an opaque core layer.

Figure 3:
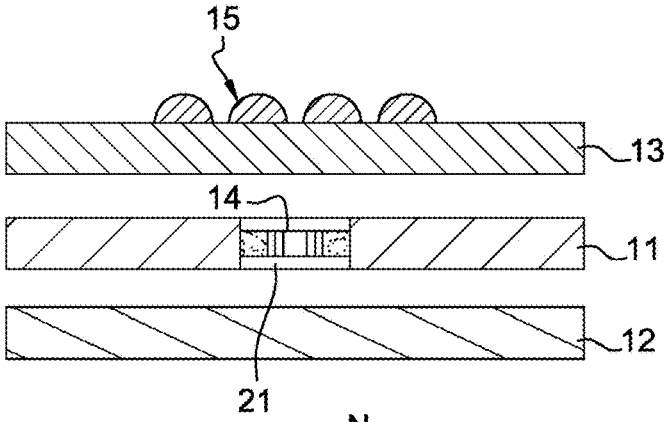

In an embodiment, the core sheet 11 of the data carrier can comprise a transparent sheet 21 on which the metal layer 14 is applied, for example vapor deposited see FIG. 3. The destroyed regions of the metal layer 14 are in this case visible from both sides, from above through the cover sheet 13 and from below through the cover sheet 12.

Figure 4:
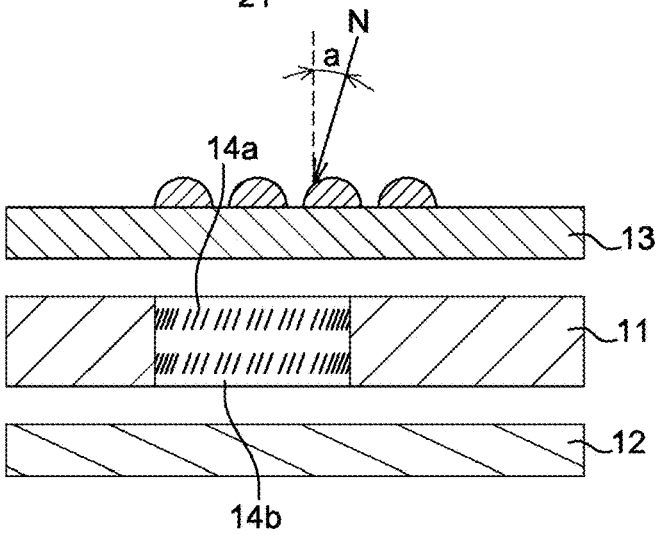

In another embodiment as shown in FIG. 4, the transparent sheet 21 of the core sheet 11 can comprise a first metal layer 14*a* and a second metal layer 14*b*. These metal layers 14*a* and 14*b* may likewise be vapor deposited or applied by hot stamping. These two metal sheets 14*a* and 14*b* are at a distance from one another of, for example, at least 50 micrometers or preferably 100 or more micrometers.

During the printing phase using the laser, as illustrated in FIG. 4, the data carrier 10 can be placed obliquely at a predetermined angle a. The holes takes place in the two metal layers 14*a* and 14*b*. If, owing to the laser intensity, it is not possible to write the two metal layers 14*a* and 14*b* from the same side of the card, two matching laser processes may also be envisioned on the rear side and the front side of the data carrier 10. In this case, the closer-lying metal layer 14*a* and 14*b* is respectively processed. By identical placement of the data carrier 10 before the laser processing, the lasered image is visible in transparent view only at the corresponding viewing angle. It is also conceivable to laser two different images with different angles from one another, and thus obtain a tilt effect between the two images, or the two metal layers 14*a* and 14*b*, during observation at different angles. The core layer 11 may, as can be seen, be fastened and in particular laminated between two layers, or cover sheets.

In an embodiment, the patterned contacting surface of the laminating plate is brought into contact with the lower cover sheet 12 to create the corresponding embossed pattern 15 on the surface of the lower cover sheet 12 to define the surface profile. During personalization, the laser printing process can be made from the the lower sheet 12 side.

Advantageously, the data carrier 10 that is produced is substantially protected against forgery and manipulation. The data carrier 10 has an effective copy protection since distinctive visual impression of the laser destroyed information and data cannot be rendered by common forgery methods. Additionally, the process for manufacturing the data carrier 10 is simple, requiring little modification to the current process and equipment. The laminating plates that are currently used for security purposes and for making changeable laser image lenses can be easily modified for embossing the laminating sheet. These laminating plates can be used for thousands of lamination cycles for producing tens of thousands of data carriers. These laminating plates are cheap.

Although the present invention is described as implemented in the above described embodiment, it is not to be construed to be limited as such. Other materials, for example, papers or plastic materials of different surface nature, such as photographic papers, passes, documents, value-bearing papers, checks, any support having an opaque layer removable by laser can be used.

The invention claimed is:

1. A method of producing a data carrier having metalized personalization features and security patterns, comprising:

placing an opaque metal layer portion applied into two layers of a body of the data carrier, the opaque metal layer portion is selected so thin that an irradiation by the laser beam results on a local destruction of said opaque metal layer portion;

placing a beam-modifying portion applied onto a surface of the body of the data carrier, said beam-modifying portion being positioned at least partially overlapping the opaque metal layer portion, said beam-modifying portion having an optical property capable of modifying a laser beam;

irradiating the laser beam to the opaque metal layer portion through the surface of the data carrier of partially destroying the opaque metal layer portion in such a way that it creates an opaque personalized data in the form of holes in the opaque metal layer portion, irradiating the laser beam to the opaque layer portion through the beam-modifying portion to allow the modifying of the laser beam according to the optical property to produce a resultant laser beam that locally destroy said opaque layer portion, in such a way that it creates an opaque pattern with a visual impression of an opaque embossed structures corresponding to the result of the irradiation of the beam-modifying portion said opaque pattern is in a superposing relation with the beam-modifying portion to create an appearance of a metalized embossing structure.

2. The method according to claim 1, wherein the data carrier is a multilayer data carrier comprising:

a first layer of plastic that comprises an upper side;

a second layer of plastic comprising a rear side and an upper side, the opaque layer is arranged on said upper side of said first layer and partially covering said upper side;

the rear side of the second layer of plastic is arranged on the first layer, said second layer being transparent at least in a subregion of the opaque layer, said upper side of the second layer comprising a plurality of raised surface portions comprising each an embossing beam-modifying portion, said embossed beam-modifying portion comprising a surface profile having an optical property capable of modifying a laser beam, said embossed beam-modifying portion being positioned adjacent or at least partially over the opaque layer portion.

3. The method according to claim 2, wherein a layer of the data carrier is printed in a color before application of the opaque layer in the first layer or the second layer, so that the color is visible after the holes into the opaque layer by the irradiation steps.

4. The method according to the claim 1, wherein the data carrier is a multilayer data carrier comprising:

the opaque layer being arranged on said rear side of said second layer and partially covering said rear side of the second layer, said second layer being transparent at least in a subregion of the opaque layer, said upper side of the second layer comprising at its upper side a plurality of raised surface portions comprising each an embossing beam-modifying portion, said embossed beam-modifying portion comprising a surface profile having an optical property capable of modifying a laser beam, said embossed beam-modifying portion being positioned at least partially over the opaque layer portion.

5. The method according to claim 1, wherein the opaque layer is laminated between the first and the second plastic layers.

6. The method according to claim 1, wherein the opaque layer is arranged in a window of the otherwise at least regionally opaque layer.

7. The method according to claim 1, wherein to create the opaque personalized data and the opaque pattern the step of partially destroying the opaque layer is using the laser beam until the metal layer has at least recessed, evaporated, color changed, color altered or removed.

8. The method according to claim 7, wherein the metal layer is vapor deposited onto the first layer or the second layer, applied by hot stamping or laminated together with a carrier layer.

9. The method according to claim 7, wherein owing to the reflection behavior of the metal layer, the metalized personalized data and the metalized pattern when viewed can be seen as positive or negative depending on the viewing angle.

10. The method according to claim 1, wherein the opaque layer comprises at least two metal sheets arranged at a distance from one another and parallel above one another, these two metal sheets are provided with holes, wherein the two metal layers are exposed vertically with respect to their plane or at an inclination with respect to their planes so that the holes extend vertically or at an inclination with respect to said planes.

11. A data carrier having the appearance of including a metalized embossing structure, comprising:

a first layer of plastic that comprises an upper side;

a second layer of plastic comprising a rear side and an upper side, an opaque metal layer that is arranged between said rear side of the second layer and the upper side of the first layer, the opaque metal layer portion is selected so thin that an irradiation by the laser beam results on a local destruction of said opaque metal layer portion thereby leaving a hole in the opaque metal layer, said rear side of said second layer of plastic being arranged on the upper side of the first layer, said second layer being transparent at least in a subregion of the opaque layer, said upper side of the second layer comprising a plurality of raised surface portions comprising each an embossing beam-modifying portion, said embossed beam-modifying portion comprising a surface profile having an optical property capable of modifying a laser beam, said embossed beam-modifying portion being positioned adjacent or at least partially over the opaque layer portion, and an opaque pattern written into the opaque metal layer by a laser beam irradiated through the beam-modifying portion thereby having rendered holes in the opaque metal layer, the opaque pattern being in a superposing relation with the beam-modifying portion thereby creating an appearance of a metalized embossing structure.

12. The data carrier according to claim 11, wherein the opaque metal layer being arranged on said rear side of said second layer and partially covering said this rear side, or the opaque metal layer being arranged on said upper side of said first layer and partially covering said this upper side.

13. The data carrier according to claim 12, wherein the data carrier is an identity card, a page of a passport, a credit card or the like.

14. The data carrier according to claim 11 wherein the opaque layer is sufficiently thin that an irradiation by the laser beam results on a local destruction of said opaque layer.

15. The data carrier according to claim 14 wherein the opaque layer comprises an opaque personalized data resulting from partial destruction by a laser beam through the surface of the data carrier.

16. The data carrier according to claim 15 wherein the opaque layer comprises a visual impression of an opaque embossed structures corresponding to the result of the irradiation of the beam-modifying portion produced by laser irradiation through the beam-modifying portion.

17. The data carrier according to claim 11 wherein the opaque layer is laminated between the first and the second plastic layers.

18. The data carrier according to claim 11 wherein the opaque layer is arranged in a window of the otherwise at least regionally opaque layer.

* * * * *